US005272993A

United States Patent [19]

Gazzarrini

[11] Patent Number: 5,272,993

[45] Date of Patent: Dec. 28, 1993

[54] MACHINE FOR FEEDING AND SEWING THE TOES OF PANTYHOSE, SIMULTANEOUSLY

[75] Inventor: Vinicio Gazzarrini, Florence, Italy

[73] Assignee: Solis, S.r.l., Florence, Italy

[21] Appl. No.: 945,735

[22] Filed: Sep. 16, 1992

[30] Foreign Application Priority Data

Sep. 18, 1991 [IT] Italy ..... FI91 A 000231

[51] Int. Cl.[5] ..... D05B 21/00

[52] U.S. Cl. ..... 112/121.15; 112/262.2

[58] Field of Search ..... 112/121.12, 121.15, 112/121.29, 262.2, 311, 262.3

[56] References Cited

U.S. PATENT DOCUMENTS

| | | | |
|---|---|---|---|
| 4,020,775 | 5/1977 | King et al. | 112/262.2 X |
| 4,120,251 | 10/1978 | Takatori et al. | 112/262.2 X |
| 4,133,280 | 1/1979 | Takatori | 112/262.2 |
| 4,364,320 | 12/1982 | Nakhle et al. | 112/262.2 |
| 4,444,140 | 4/1984 | Moyer | 112/262.2 |
| 4,516,513 | 5/1985 | Gazzarrini | 112/121.15 X |
| 4,519,327 | 5/1985 | Selvi | 112/121.15 |
| 4,649,838 | 3/1987 | Gazzarrini | 112/121.15 |
| 5,014,634 | 5/1991 | Hodges et al. | 112/262.2 |
| 5,129,337 | 7/1199 | Humphrey | 112/121.15 |

FOREIGN PATENT DOCUMENTS

| | | | |
|---|---|---|---|
| 136391 | 4/1987 | European Pat. Off. . | |
| 0168882 | 9/1984 | Japan | 112/121.15 |
| 0119201 | 6/1985 | Japan | 112/262.2 |
| 2029195 | 3/1980 | United Kingdom | 112/121.15 |

*Primary Examiner*—Clifford D. Crowder
*Assistant Examiner*—Ismael Izaguirre
*Attorney, Agent, or Firm*—McGlew and Tuttle

[57] ABSTRACT

To obtained the automatic toe-sewing of two stockings, especially of pantyhose articles, a machine is used having horizontal carrousel structure to support pairs of stockings (3) upon two parallel everter hoses (1) provided with sliding fingers (10) for the withdrawal of the toe to be sewn. Structure (40, 41, 5) for blocking and temporarily turning right-side out and aligning the edge of the toes to be sewn is provided. Structure (7) for blocking the toes of the stockings (3) with the edge thus turned right-side out and aligned on a sewing surface (6) and slidingly transferring them to a sewing machine (8) is provided. Further, Structure (9) for withdrawing a portion of the stocking (3) from the everter hoses (1) so as to favor the above mentioned transfer is provided.

9 Claims, 7 Drawing Sheets

Fig. 1
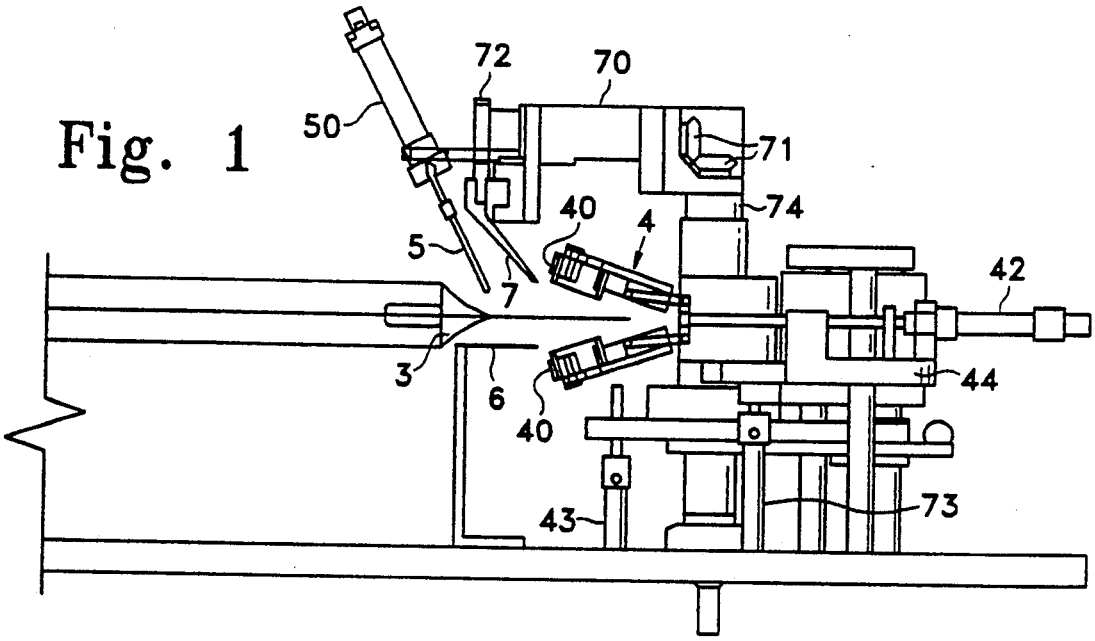
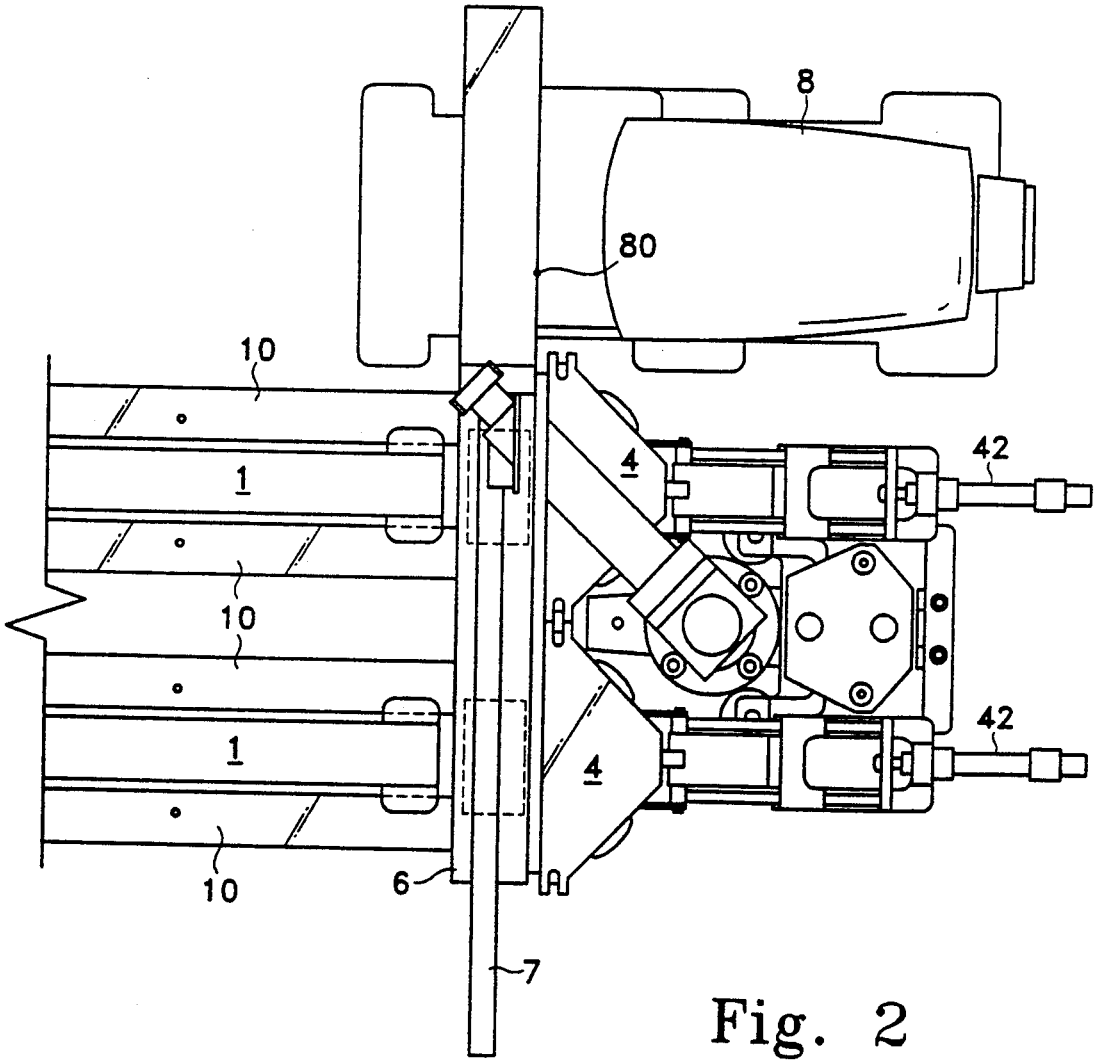
Fig. 2

Fig. 5
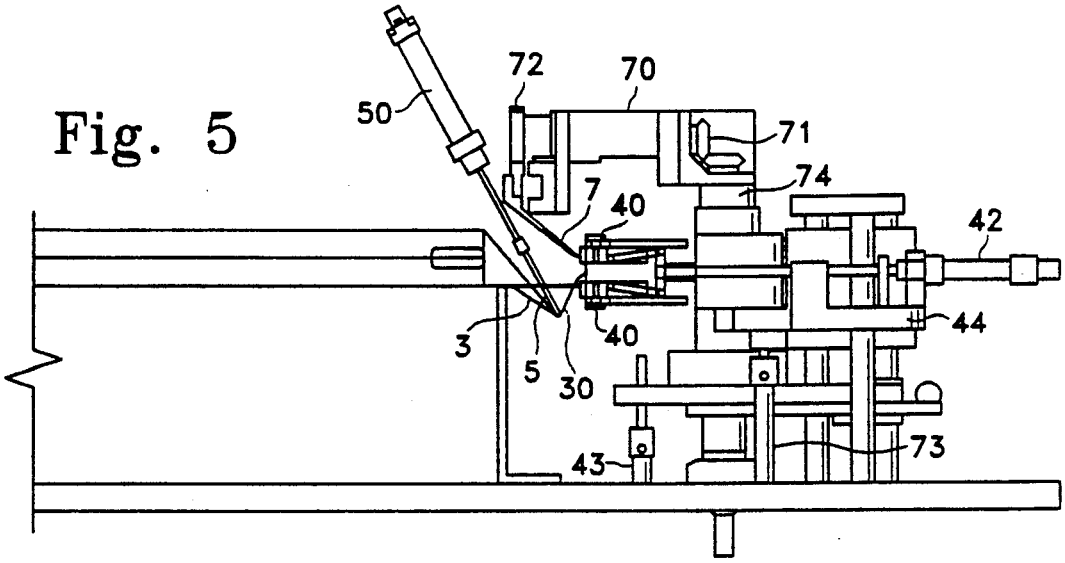
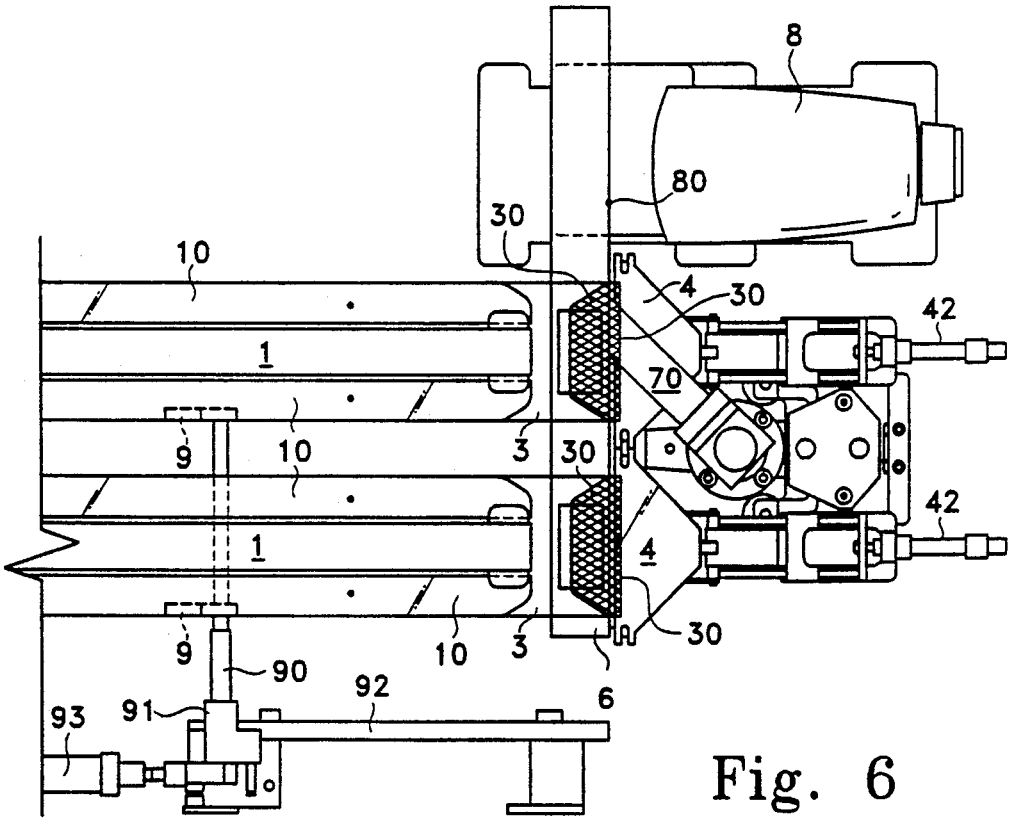
Fig. 6

Fig. 7
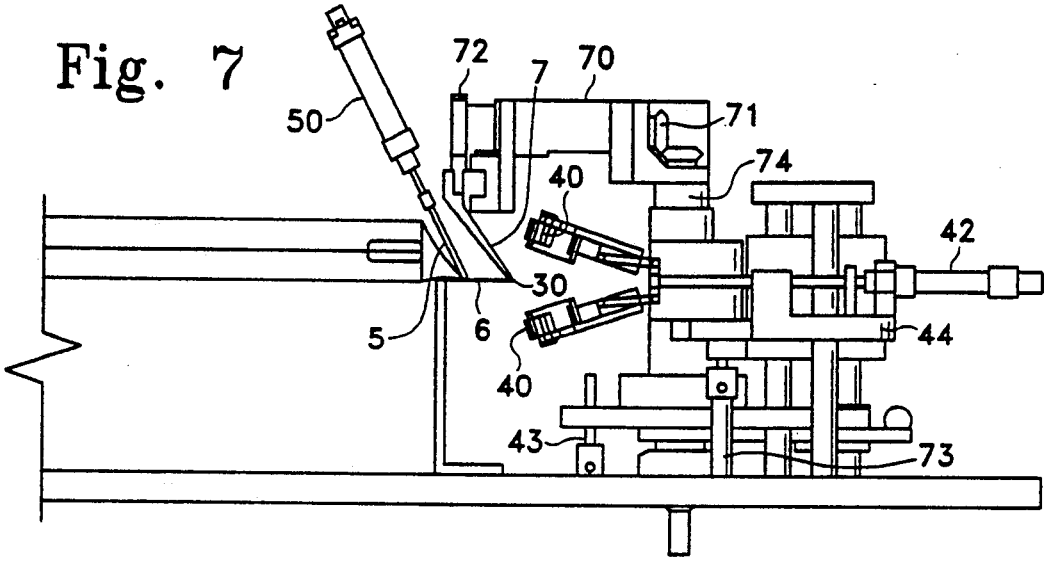
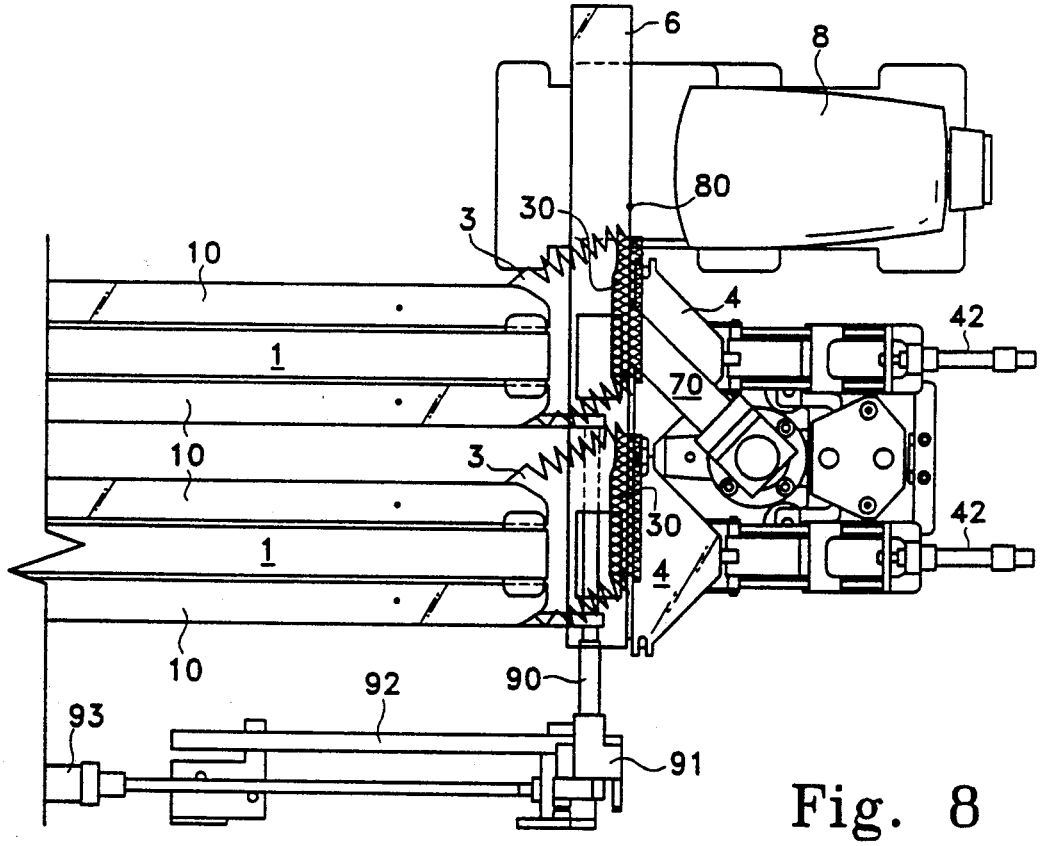
Fig. 8

MACHINE FOR FEEDING AND SEWING THE TOES OF PANTYHOSE, SIMULTANEOUSLY

FIELD OF THE INVENTION

The present invention refers to a machine for automatically sewing the toe of two stockings at the same time, and in particular of pantyhose articles.

BACKGROUND OF THE INVENTION

It is known from patent EP 136.391 by the same owner, a machine for sewing the toe of pantyhose articles by two seamers at two separate stations, said seamers performing the closing of the toe of the right, respectively left stocking of two distinct pantyhose articles at the same time.

It is known by experience that a drastic reduction of the time for sewing the pantyhose toes by means of two seamers is heavily penalized when said machine is associated upstream or respectively downstream with another machine having a longer work time, such as a machine for making pantyhose articles or respectively for sewing the pantyhose gusset.

SUMMARY AND OBJECTS OF THE INVENTION

The main object of the present invention is to provide a machine for sewing the pantyhose toes which is advantageously upstream connected with a pantyhose-making machine and/or downstream connected with a pantyhose gusset-sewing machine.

This result has been achieved according to the invention by adopting the idea of using a machine having horizontal carrousel means to support pairs of stockings upon two parallel everter hoses provided with sliding fingers for the withdrawal of the toe to be sewn and comprising:

means for blocking and temporarily turning right-side out and aligning the edge of the toes to be sewn;

means for blocking the toes of the stockings having their edges thus turned right-side out and aligned on a sewing surface and slidingly transferring them to a sewing machine;

means for withdrawing a portion of the stocking from the everter hoses so as to favour the above mentioned transfer.

The advantages attained from the present invention lie essentially in that it is possible to temporarily deform the toe of the two stockings so as to obtain a straight profile corresponding to the seam line to be made; that said straight profile edge of one stocking lies on the extension of the edge, having the same profile, of the other stocking; that it is possible to make said temporary straight profile of the two stockings depend on a preventive and variable tensioning of the fabric in correspondence of the toe and as a function of the bending radius to be achieved after the seaming; that it is possible to transfer said edge having temporary straight profile of two single stockings or of one pantyhose article in alignment from the everter hoses up to the seamer which performs the seaming in the succession.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein:

FIG. 1 is a front view of a machine according to the invention, in the initial operating stage;

FIG. 2 is a plan view of the machine of FIG. 1;

FIG. 5 shows a front view of the machine of FIG. 1 in an intermediate stage of temporary turning the toe of the two stockings right-side out;

FIG. 6 shows a plan view of the machine of FIG. 1 in the condition upon which the temporary turning right-side out of the toe of the two stockings has already taken place;

FIG. 7 shows a front view of the machine of FIG. upon the blocking of the toe of the two stockings after they have temporarily been turned right-side out;

FIG. 8 shows a plan view of the machine of FIG. 1 upon the transfer of the toe of the two temporary turned right-side out stockings towards the seamer;

DETAILED DESCRIPTION OF THE PREFERRED EMBODIMENT

Figure 3:
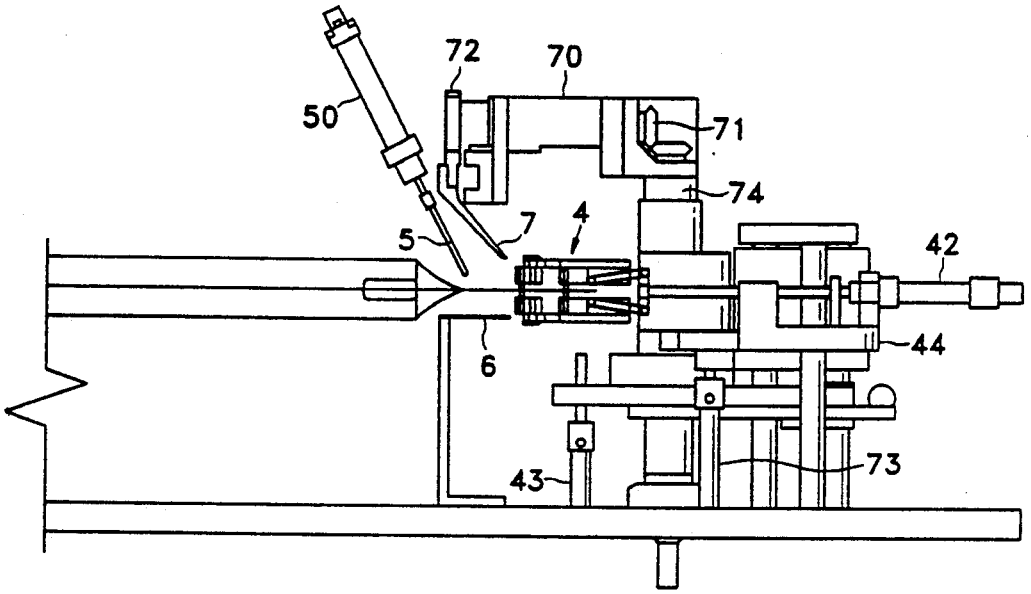
FIG. 3 shows a front view of the machine of FIG. 1, in the stage when the toe of the two stockings is blocked for the sewing thereof.
Figure 4:
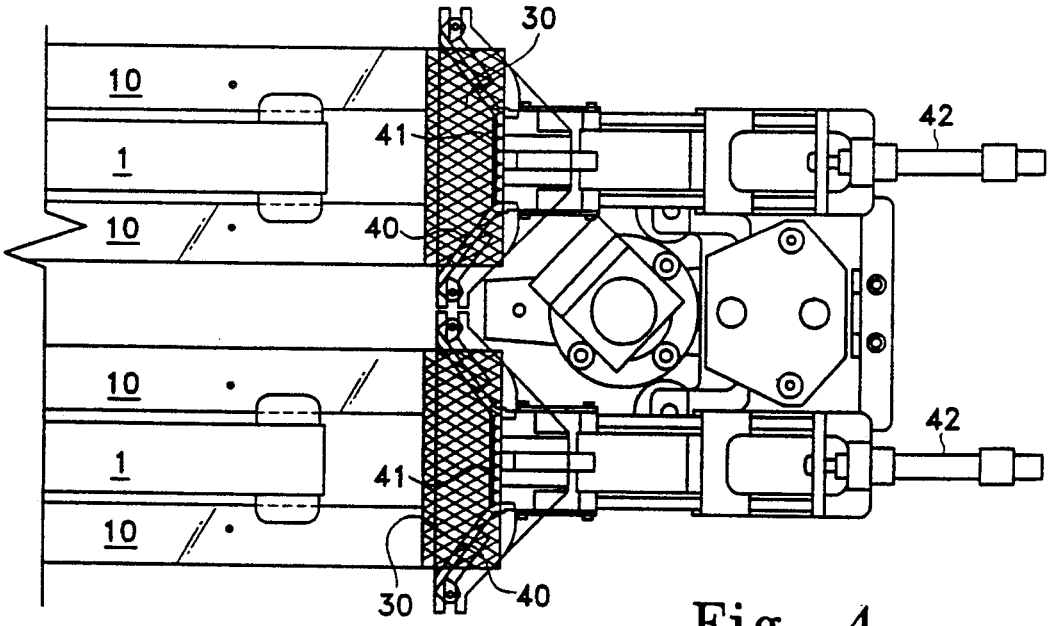
FIG. 4 shows a plan view of the machine of FIG. 3.
Figure 9:
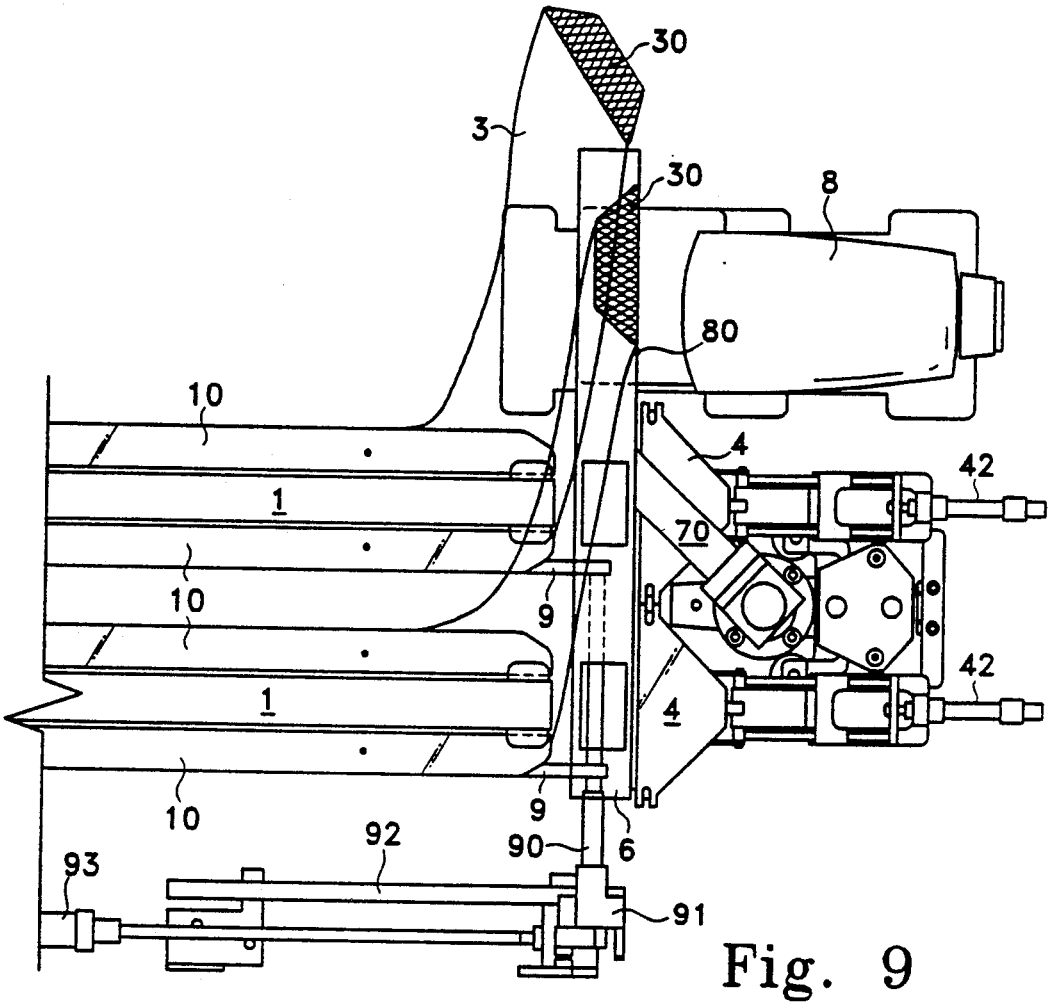
FIG. 9 shows a plan view of the machine of FIG. 1 upon completion of seaming of the two stocking toes.
Figure 14:
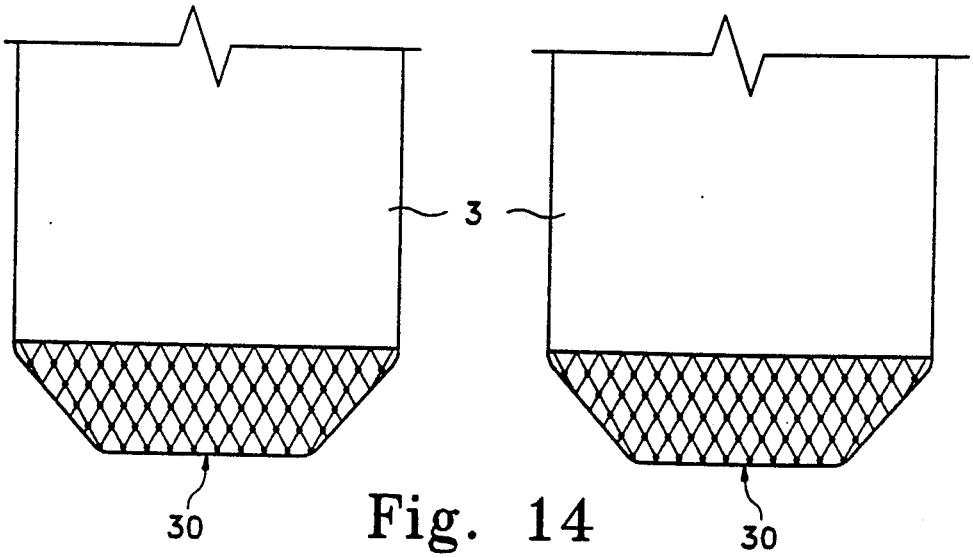
FIG. 14 is a plan view showing in detail the toe of two stockings after the seaming thereof by the machine of FIG. 1.
Figure 11:
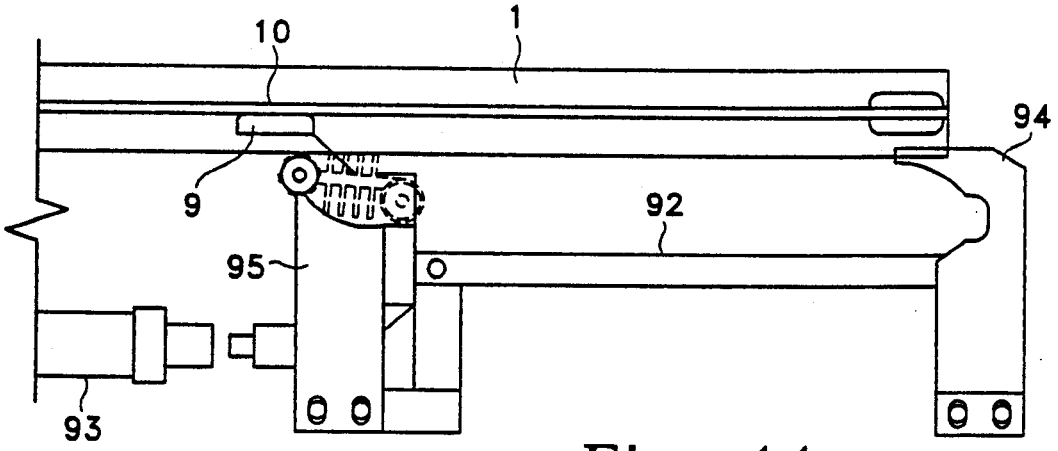
FIG. 11 shows a front view of the pusher of FIG. 10.
Figure 10:
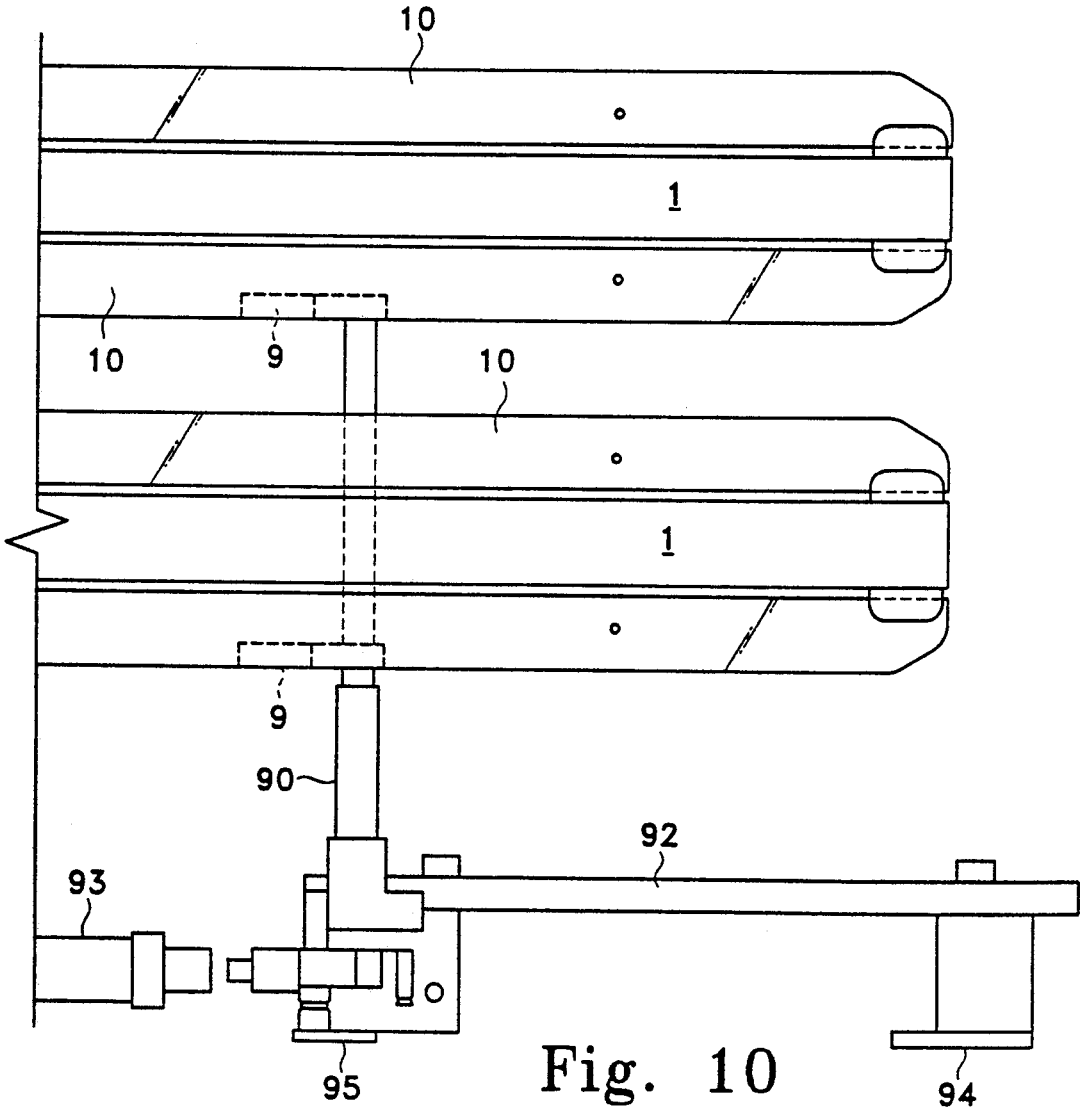
FIG. 10 is a plan view showing in detail the stockings pusher on the everter hoses prior to the seaming of the toes, at start-of-stroke position.
Figure 13:
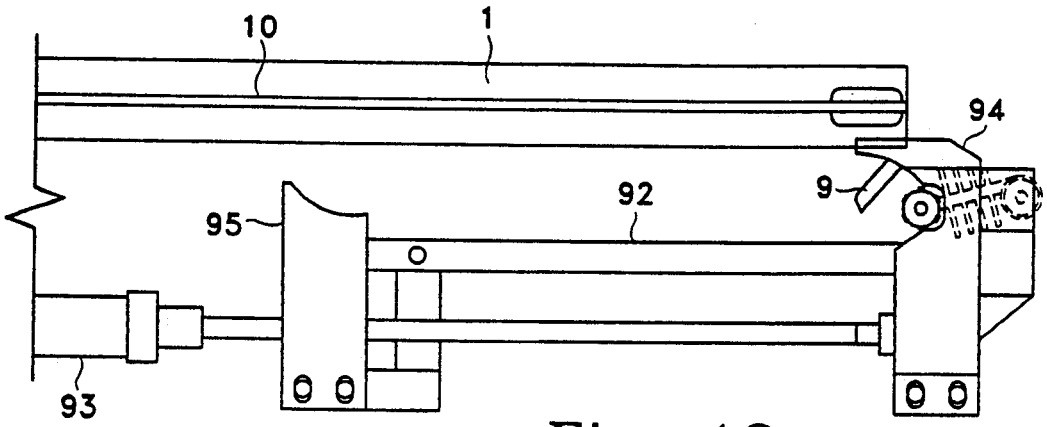
FIG. 13 shows a front view of the apparatus of FIG. 12.
Figure 12:
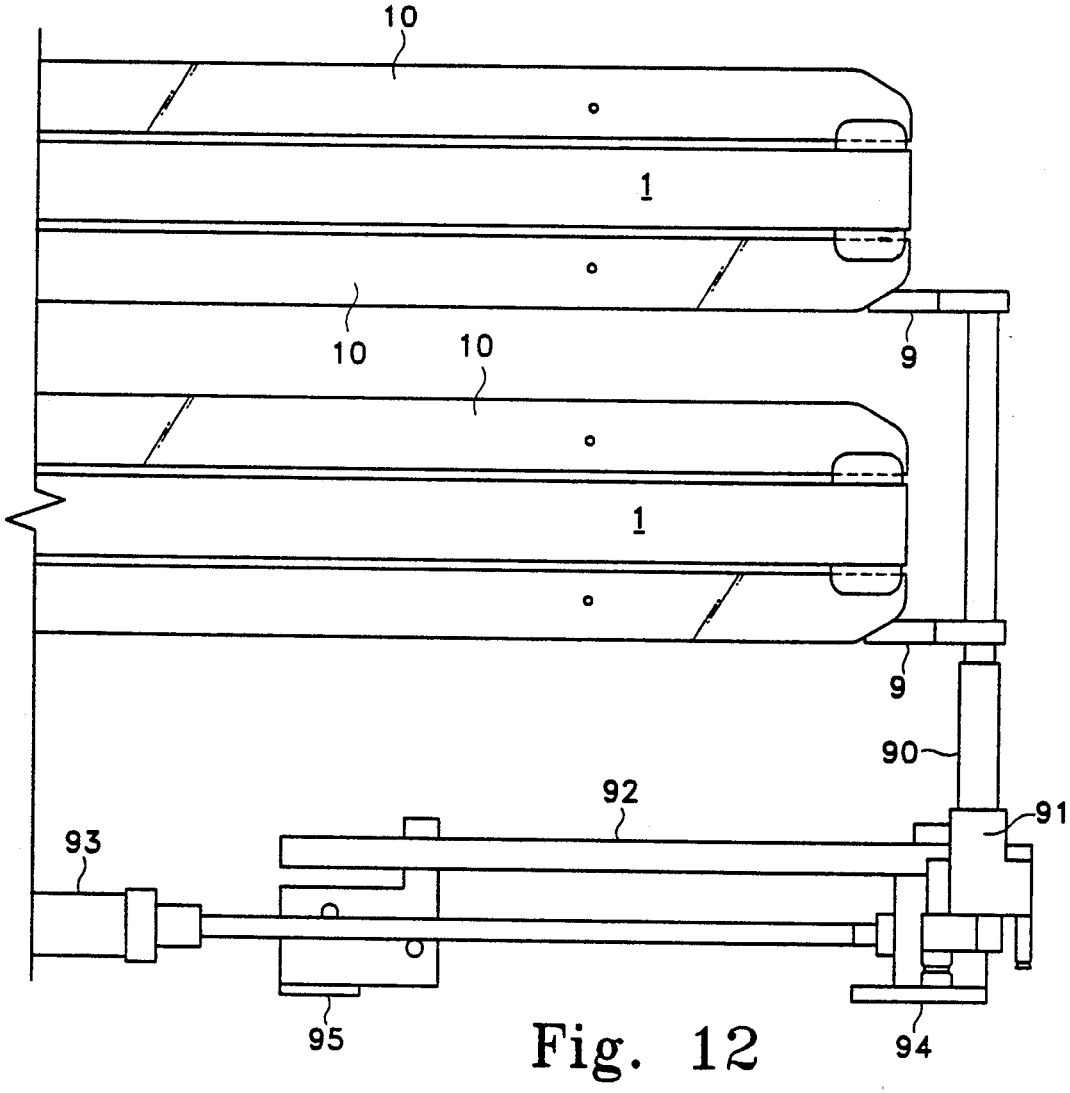
FIG. 12 shows a plan view of the apparatus of FIG. 10 at end-of-stroke position.

Reduced to its basic structure and with reference to the attached drawings, a machine for the automatic simultaneous sewing of the toe of two stockings, especially of pantyhose articles, comprises:

means for supporting one or more pair of stockings 3 on corresponding horizontal everter hoses 1 provided with side fingers 10 able to withdraw the toe to be sewn, said supporting means being of carrousel type intermittently rotating about a vertical axis and with dwell in the sewing station as described in the patent EP 136.391;

means for blocking and temporarily deforming, that is, turning right-side out and aligning, the profile of the toe 30 of the two stockings by means of a clamp for each stocking, the jaws of said clamp being made up of two elements 40 of variable geometry, horizontally oscillating by means of a pneumatic cylinder 42 whose stroke is made to change by adjustable limit stops, and connected to one another via a rubber listel 41 in order to seize the side regions of the toe 30 and simultaneously withdraw the central region until a straight profile perpendicular to the longitudinal axis of hoses 1 is obtained: a blade extender 5, which is driven into vertical reciprocating motion by a pneumatic cylinder 50, is made to act downwards on said central region of the toe of each stocking to ease said withdrawal;

means for blocking the toe of the two stockings having the thus modified profile, onto a horizontal stationary sewing surface 6, and an overlying plate presser 7 provided with vertical reciprocating motion to engage the two toes to be sewn on said surface and to slidingly transfer them simultaneously, with a vertical reciprocating motion, to a sewing machine 8 whose vertical needle 80 grazes the edge of said surface 6.

Said presser 7 slides parallel to the surface 6 within an arm 70 which supports also the gears 71,72 driving the presser 7 into horizontal motion, while a connecting rod 43 drives, via a column 74, the vertical motion of same presser. Also associated to said arm 70 are two extenders 5;

means to ease the transfer of the stocking toes to be sewn from the region in front of the respective everter hoses 1 to the sewing machine 8, by means of a pusher 9 for each stocking, said pusher—by pressing onto the fabric from under a finger 10 and moving parallel thereto as far as the free end thereof—provides for withdrawing a portion of stocking from a relevant hose 1: the two pushers 9 being vertically and rotatively mounted on an arm 90 which is transverse to hoses 1 and solidly connected to a slide 91 sliding on a rail 92 and driven by a pneumatic cylinder 93 and two cams 94,95, one of which being provided for the end of the forward stroke, that is, with the stocking being still engaged, and the other for the end of the return or idling stroke, causing the pushers 9 to rotate from the lifted or working position to the lowered or inoperative position, and vice versa.

The operation is as follows.

When a carrousel arm with a pair of everter hoses 1 and relevant stockings 3 stops at the sewing station, the fingers 10 are made to advance or have already been moved ahead in a known manner beyond the free end of hoses 1 so that the toe regions 30 of the stockings find themselves inside the open mouth of the clamps 4 (see FIG. 1); thereafter, the jaws of clamps 4 are closed and the fingers withdrawn so that the toe regions 30 of the stockings remain blocked between the jaws 40. Afterwards, while the clamps 4 are lowered by the action of the connecting rod 73 onto the support 44, as far as to bring the toe regions of the stockings onto the sewing surface 6, the jaws 40 are rotated towards the everter hoses and, at the same time, the blade extenders 5 are made to push the central part of the regions of toe 20 downwards, so that the listels 41, with, the interposed edge of the stocking toe, result in them being lined up in a direction perpendicular to the axis of hoses 1 in correspondence of the edge of the sewing surface 6, and the fabric of the stockings toe region are caused to undergo a corresponding elastic deformation, that is, a temporary tension (see FIG. 8). At this point, the plate presser 7 is lowered down to block the two toe regions 30 with the relevant edges to be sewn being lined up, and the jaws of clamps 4 are opened out (see FIG. 7).

Finally, while the pushers 9 withdraw from the hoses a corresponding portion of stocking, the presser 7 moves back towards the seamer 8 by causing the two toe regions 30 of stockings 3 to slide onto the sewing surface 6 and transit in front of the needle 80 of seamer 8 beyond which they ar released. After being completely sewn and being released from the hold of presser 7, the toe regions 30 of the stockings lose the elastic deformation previously imposed by the clamps 4 and maintained by the presser 7, thereby causing the fabric to resume its natural shape while the seam line takes up a curvilinear development with the convexity turned outwards, or a multilinear development with a deflection varying according to the more or less rotation imposed on the jaws 40 and to the tension that the central region is made to undergo by the blade extenders 5.

Practically, all the construction details may vary in any equivalent way as far as the form, dimensions, elements disposition, nature of the used materials are concerned, without nevertheless departing from the scope of the adopted solution idea and, thereby, remaining within the limits of the protection granted to the present patent for industrial invention.

I claim:

1. Machine for automatic sewing of a toe of two stockings at the same time, comprising:

rotating carousel means for rotating horizontally and intermittently for supporting pairs of stockings upon two horizontal substantially parallel everter hoses;

sliding side fingers, positioned on the side of said everter hoses for withdrawal of the toes to be sewn;

means for blocking and temporarily deforming the profile of the toes of the two stockings to turn right-side out and to align said two stockings, said means for blocking including a clamp for each stocking toe, said clamp including pair jaws having a horizontally variable geometry, said paired jaws being connected to each other through a rubber listel for seizing side regions of said stocking and simultaneously withdrawing a central region thereof until a straight profile is formed perpendicular to a longitudinal axis of said everter hoses whereby said straight profile is obtained for sewing;

means for blocking each toe of the two stockings, which profile has been temporarily deformed, onto horizontal sewing surface with a longitudinal plate presser lying there above;

a sewing machine;

rectilinear motion means for glidingly transferring said toe's in said blocking means to a position in front of a needle of said sewing machine; and withdrawing means for withdrawing an equal portion of each stocking from said everter hoses for transfer of said toe's to said sewing machine, including a pusher acting from under each stocking in correspondence with said sliding side fingers of each everter hose.

2. Machine according to claim 1, wherein said paired jaws of said clamping means for made up of two spaced apart elements articulated at diametrically opposite ends and driven into discordant rotation by a pneumatic cylinder.

3. Machine according to claim 2, wherein said discordant rotation by said pneumatic cylinder is adjustable to allow a tensioning of a region at the toe of the stockings to be varied prior to sewing in order to obtain a different curvilinear or multi-linear profile of the toe being sewn.

4. Machine according to claim 1, wherein said clamping means has associated therewith two blade extenders engaged to corresponding pneumatic cylinders for downwardly pressing onto a central part of a region of the toe of the stockings while being acted upon by said clamping means to achieve said straight profile.

5. Machine according to claim 4, wherein said blade extenders and corresponding pneumatic cylinders are supported by an arm.

6. Machine according to claim 5, wherein a cam is connected to said pushers for driving said pushers into a standing and a lowered position corresponding to a beginning and an end of an operative stroke.

7. Machine according to claim 4, wherein said pneumatic cylinders are associated with said clamping means are mounted on a support, said support being vertically driven into motion by a connecting rod.

8. A machine according to claim 1, wherein said longitudinal plate presser is slidingly mounted parallel to an edge of said sewing surface, motion means being connected to said plate presser, said motion means being mounted on top of a column and vertically moveable by a connecting rod.

9. Machine according to claim 1, further comprising an arm fixed to a slide, said slide being connected to a pneumatic cylinder for driving said arm into motion in one of two directions along a rail, said rail being parallel to said everter hoses, said pushers being mounted on said arm.

* * * * *